US006581931B1

(12) United States Patent
Doepner et al.

(10) Patent No.: US 6,581,931 B1
(45) Date of Patent: Jun. 24, 2003

(54) GAME BOARD STRUCTURE FOR CONSTRUCTION TOY SET

(75) Inventors: Matthias F. W. Doepner, Harleysville, PA (US); Brian Moletsky, Souderton, PA (US)

(73) Assignee: Connector Set Limited Partnership, Hatfield, PA (US)

( * ) Notice: Subject to any disclaimer, the term of this patent is extended or adjusted under 35 U.S.C. 154(b) by 0 days.

(21) Appl. No.: 10/059,748

(22) Filed: Jan. 29, 2002

(51) Int. Cl.[7] ..... A63F 7/36

(52) U.S. Cl. ..... 273/118 A; 273/287; 273/237; 273/282.1; 446/91; 446/108

(58) Field of Search ..... 273/118 A, 119 A, 273/120 A, 121 A, 123 A, 124 A, 125 A, 287, 237, 282.1, 454; 446/91, 108, 124, 127

(56) References Cited

U.S. PATENT DOCUMENTS

| | | | | | |
|---|---|---|---|---|---|
| 2,531,979 | A | * | 11/1950 | Hobbs | 273/120 A |
| 2,790,153 | A | | 4/1957 | Larson | |
| 4,838,557 | A | * | 6/1989 | Floyhar | 273/237 |
| 5,061,219 | A | * | 10/1991 | Glickman | 446/126 |
| 5,137,486 | A | * | 8/1992 | Glickman | 446/126 |
| 5,199,919 | A | * | 4/1993 | Glickman | 446/126 |
| 5,344,143 | A | * | 9/1994 | Yule | 273/118 R |
| 5,350,331 | A | * | 9/1994 | Glickman | 446/126 |
| 5,431,400 | A | * | 7/1995 | Metz | 273/157 R |
| 5,445,552 | A | * | 8/1995 | Hine | 446/477 |
| 5,779,515 | A | * | 7/1998 | Chung | 446/90 |
| 6,068,533 | A | * | 5/2000 | Glickman et al. | 446/111 |
| 6,147,673 | A | | 11/2000 | Zarek | |
| 6,193,609 | B1 | | 2/2001 | D'Archard Van Enschut | |

* cited by examiner

*Primary Examiner*—Raleigh W. Chiu
(74) *Attorney, Agent, or Firm*—Schweitzer Cornman Gross & Bondell LLP

(57) ABSTRACT

A game board structure for a construction toy set. A basic game board is formed of three generally rectangular panel assemblies of hollow construction. The panels have interengaging projections and recesses for mechanically locking the panels together to form a flat playing surface for various rolling ball games, such as pinball and speedball. Joining of the panels automatically connects the panels together electrically for scoring and control functions throughout the board. The assembled game board accommodates mounting of a score-indicating panel in different locations, for different playing modes, such as pinball, typically played by one person, and head-to-head games, such as speedball, played by two persons. The assembled game board panels interface with rod and connector elements of the K'NEX construction toy system, enabling a variety of structural features to be incorporated into the game board assembly, including support structure, peripheral fencing, player-controlled flippers, ball handling and projection mechanisms, etc. A complete game kit, consisting of the individual panel assemblies and a wide variety of K'NEX components is provided as a complete kit, to enable a variety of games and playing modes to be derived and assembled by the user. A suitable graphics panel can be applied to the game board surface, which also provides a more uniform playing surface for a rolling ball.

26 Claims, 7 Drawing Sheets

FIG. 3
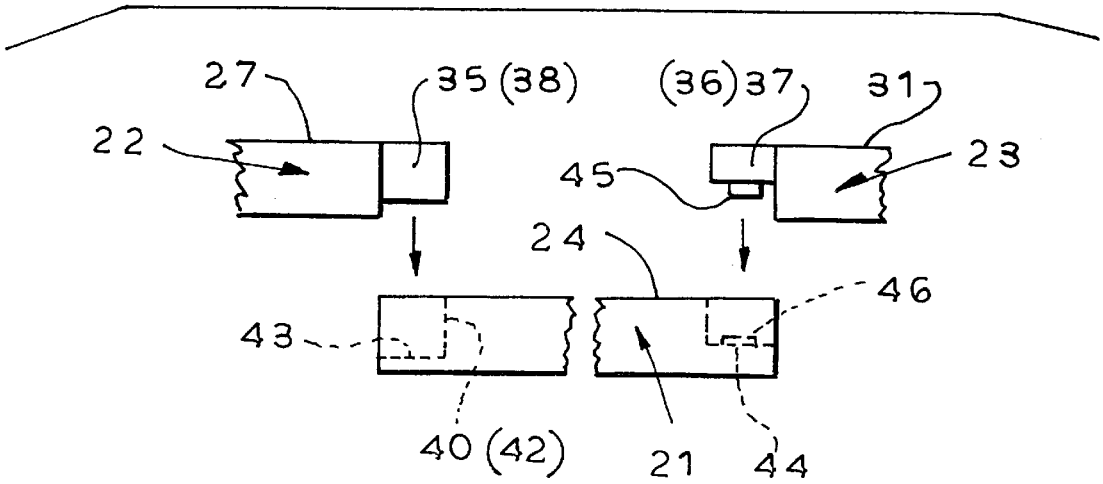
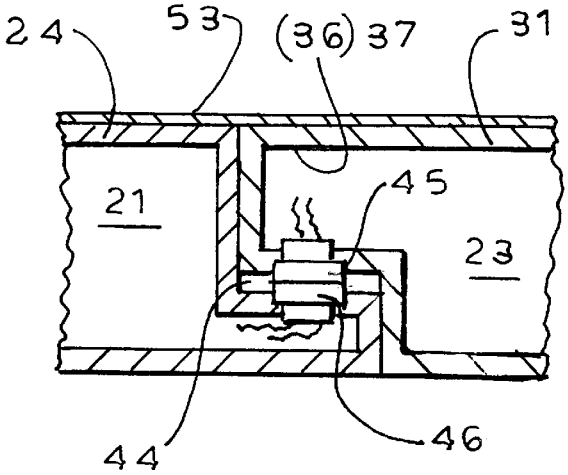
FIG. 4
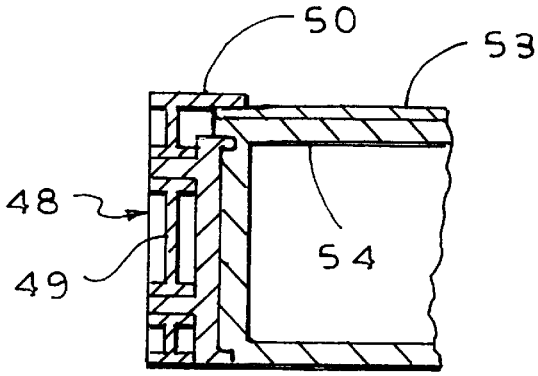
FIG. 5

FIG. 6
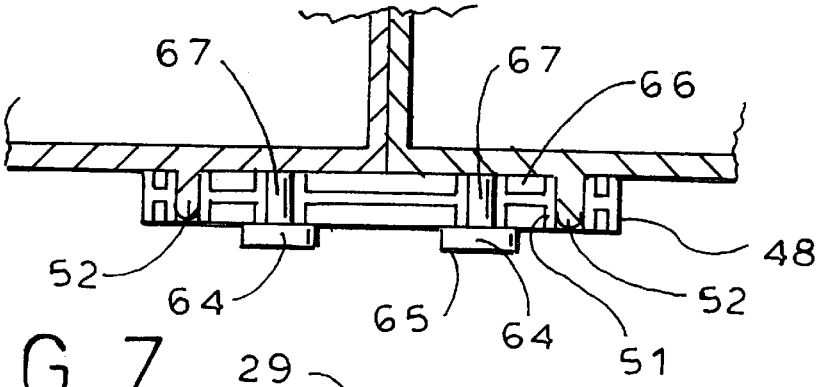
FIG. 7
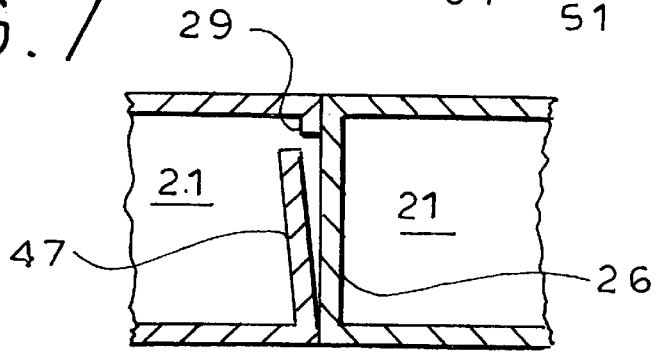
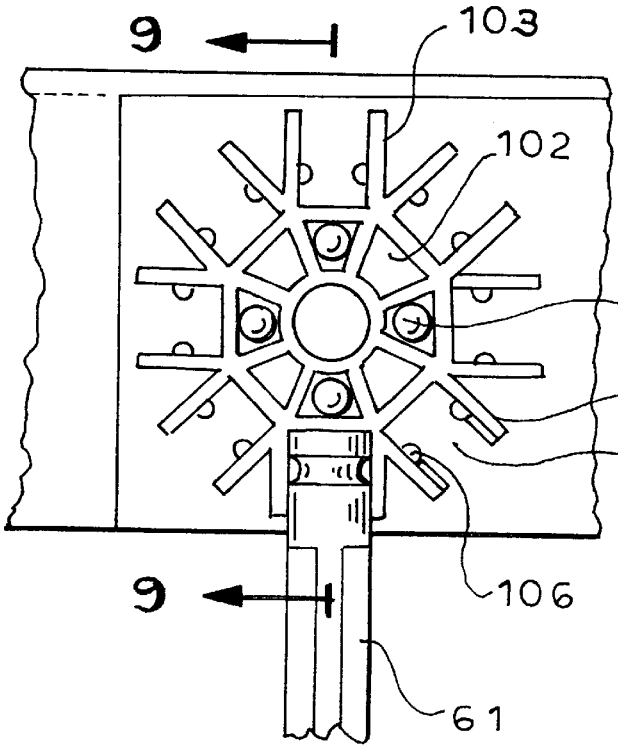
FIG. 8
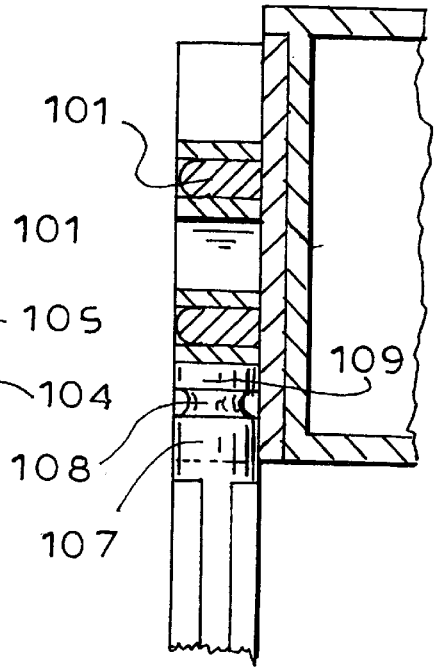
FIG. 9

GAME BOARD STRUCTURE FOR CONSTRUCTION TOY SET

BACKGROUND OF THE INVENTION

The invention relates to the field of construction toy sets, particularly but not exclusively to construction toy sets of the rod and connector type widely sold under the trademark "K'NEX", by K'NEX Industries, Inc., of Hatfield, Pa. Construction toy sets of the general type referred to typically include a wide variety of rods and connectors of various lengths and configurations, which can be assembled by the user according to prepared instructions or according to the independent desires of the user. The present invention is intended to expand the typical usage of the construction set to accommodate the construction of a game board which can be assembled using known construction toy components together with new components to enable the construction of game-playing structures of various types and configurations to suit the desires of the user.

SUMMARY OF THE INVENTION

In accordance with the invention, a special construction toy set is provided which accommodates the assembly of a game board in a variety of configurations, utilizing an assembly of special panels together with various structural components of a rod and connector construction toy, such as a K'NEX construction set, to form a virtual electronic arcade for the playing of games such as pinball, or head-to-head games, such as speedball played by two contestants, attempting to direct a ball into the other player's goal, etc. The game board structure is comprised principally of a plurality of panel assemblies which can be placed end-to-end to form a playing surface. Respective panels are formed with mutually engageable projections and sockets enabling the several panels to be locked rigidly together in end-to-end fashion. Certain of the mutually engaging projections and sockets are formed with electrical connections, enabling electrical signals to be transferred between panels and enabling signals derived from the play of a particular game to affect the play of the game and also to be transmitted to a score indicating panel which is removably attachable to the game board structure in accordance with the game being played.

In accordance with a preferred embodiment of the invention, special stiffening panels are removably attachable to opposite side edge panels of the game board panel assemblies, bridging the joint between adjacent panel assemblies and serving to lock the joined panels in their assembled positions and to provide added strength and stiffness to the assembly of game board panels.

In a preferred form of the invention, three panel assemblies are provided, one for each end and one for the center of the game board structure. Certain of the panel assemblies, preferably those at each end, are provided with projections along end edges thereof for reception in and engagement with correspondingly shaped recesses provided in the central panel assembly. An advantageous form of such projections and recesses is in the nature of a dovetail configuration, enabling assembly by vertical motion. By providing multi-pin connector pairs in selected ones of the projections and recesses, the several panels can communicate with each other electronically to provide for scoring and other control features in response to the play of a game.

The game board structure as described above is, pursuant to the invention, arranged to incorporate structural components of a K'NEX rod and connector system, so that various structural features may be incorporated together with the panel structure. Among these, mounting pins are provided at various positions along side panels of the several panel assemblies for mounting of connector elements. From these mounted connector elements, various structural arrangements may be assembled using construction rods and other connectors, including supporting structure, ball guides, ball handling mechanisms, etc. according to choices of the builder. Additionally, the top surface of the game board structure is provided with openings for the selective reception of construction rods and of scoring bumpers, so that the games may be redesigned according to the desires of the players, and various degrees of difficulty may be built in through the use of various combinations of the K'NEX rod and connector components, as determined by the players.

In accordance with another aspect of the invention, provisions are made for mounting a scoreboard either at one end or one side of the game board assembly, with plug-in connections to the electronic system, so that various schemes of automatic scoring may be accommodated.

For the above and other features and advantages of the invention, reference should be made to the following detailed description of preferred embodiments, and to the accompanying drawings.

DESCRIPTION OF THE DRAWINGS

FIG. 3 is a fragmentary sectional view of connecting means for joining adjacent game board panel assemblies.

FIG. 4 is an enlarged fragmentary cross sectional view as taken generally on line 4—4 of FIG. 1, illustrating multi-pin electrical connectors incorporated in selected projections and recesses provided for joining panel assemblies of the game board structure.

FIG. 5 is an enlarged fragmentary cross sectional view as taken generally on line 5—5 of FIG. 1, illustrating details of a stiffening panel feature used in securing joined panel assemblies.

FIG. 6 is an enlarged fragmentary cross sectional view as taken generally on line 6—6 of FIG. 1, showing other details of the stiffening panel feature.

FIG. 7 is an enlarged fragmentary cross sectional view as taken generally on line 7—7 of FIG. 1, showing certain details of panel construction.

FIG. 8 is an enlarged fragmentary side elevational view illustrating the manner in which K'NEX connectors and rods are incorporated together with the panel structure, for providing structural support and other useful structure.

FIG. 9 is a cross sectional view as taken generally on line 9—9 of FIG. 8.

DESCRIPTION OF PREFERRED EMBODIMENTS OF THE INVENTION

Figure 2A:
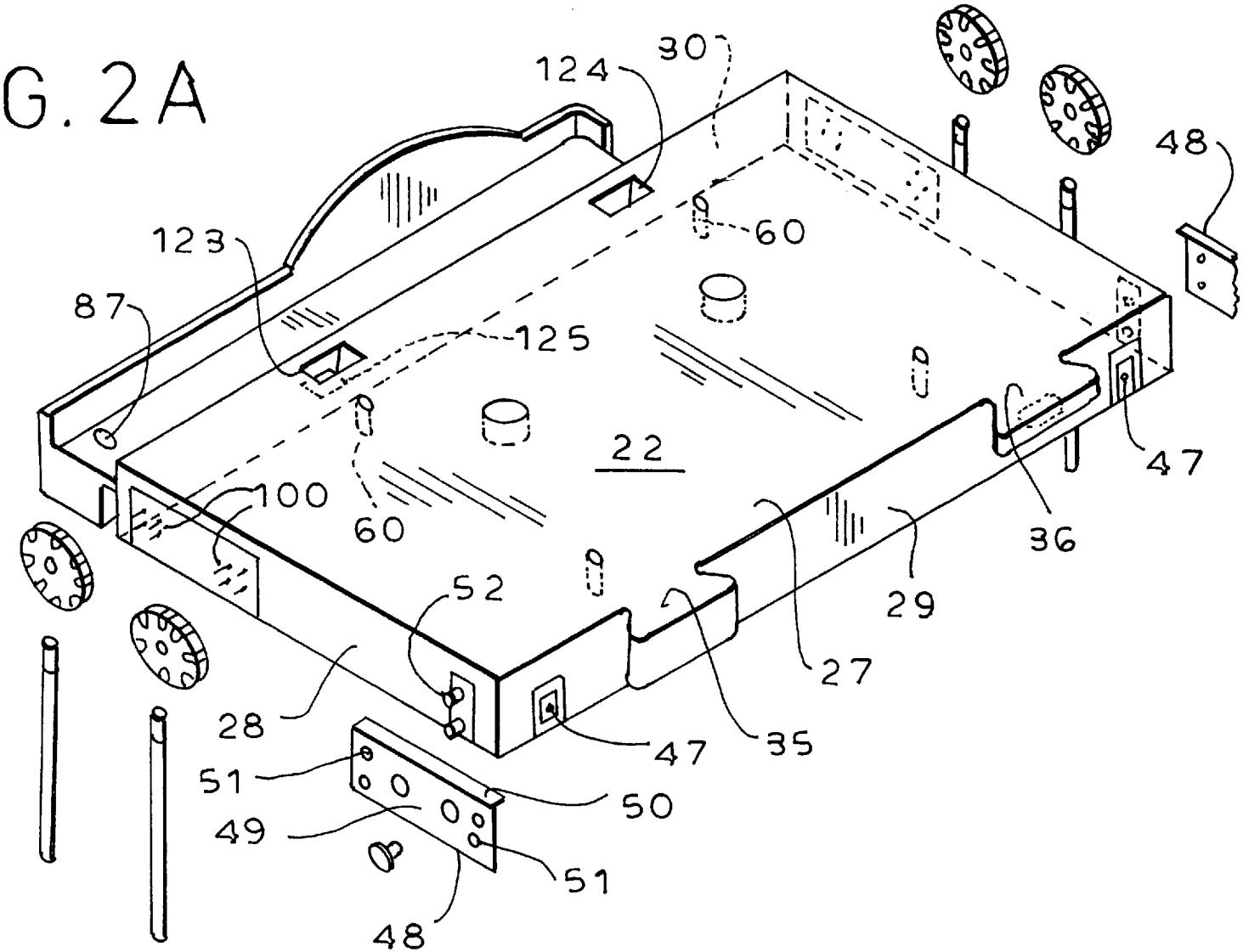
FIGS. 2*a*, 2*b* and 2*c* are enlarged top perspective views of the individual panel assemblies making up the game board structure of FIG. 1, with component parts shown in exploded form.
Figure 2B:
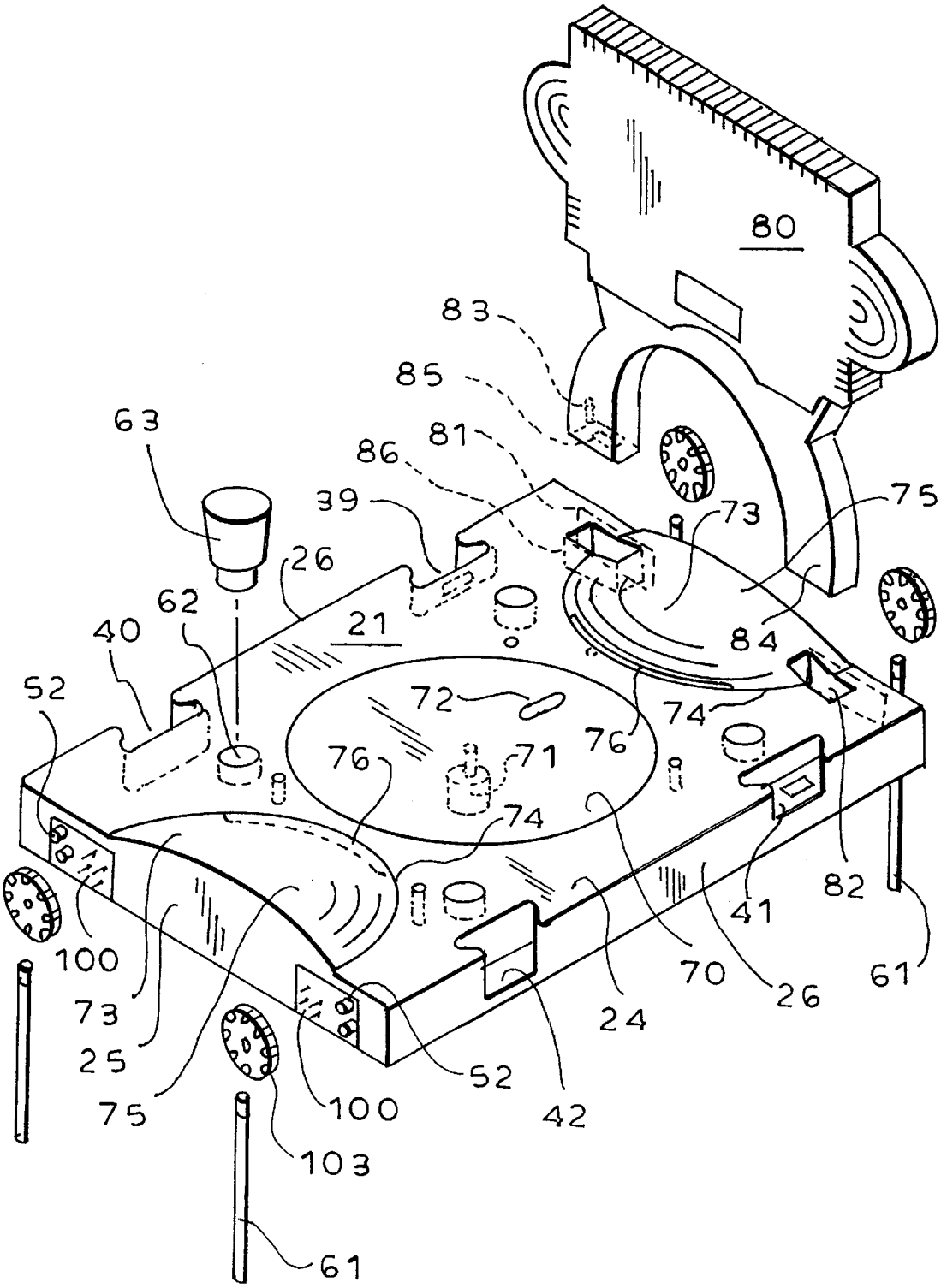
Figure 2C:
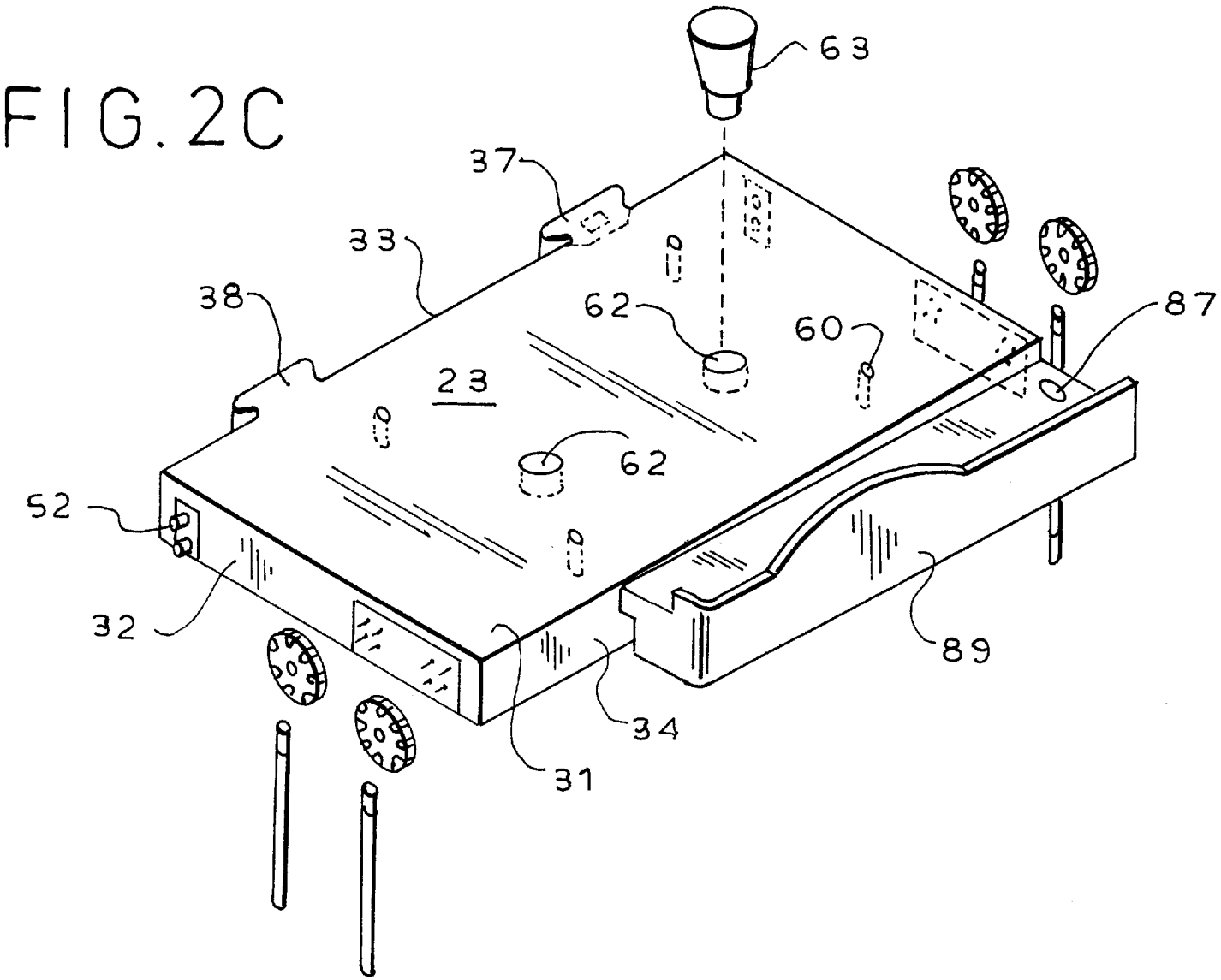

Referring now to the drawing, the reference numeral 20 designates generally a game board structure comprised of a central panel assembly 21 and opposite end panel assemblies 22, 23. The individual panel assemblies 21–23, shown in somewhat greater detail in FIGS. 2*a*, 2*b* and 2*c*, are of a hollow construction and preferably of rectangular configuration. For example, the central panel assembly 21 is formed of plastic material and is comprised of an upper panel 24, a bottom panel (not shown), opposite side edge panels 25 and opposite end edge panels 26. These panels define a rigid, hollow structure which houses various components, such as wiring, drive motors, sockets for other components, etc. as will be more fully described.

Pursuant to certain aspects of the invention, the game board structure forms part of a kit of initially unassembled parts, including the three panel assemblies 21–23 and a variety of types and sizes of construction toy elements, preferably rods and connectors of the K'NEX construction toy system as reflected in, for example, in Joel Glickman U.S. Pat. Nos. 5,061,219, 5,137,486, 5,199,919 and 5,350,331. These rods and connectors, together with other specialized game-playing components, are intended to be assembled by the user in a variety of configurations, for the playing of various games, including, as principal modes, varieties of pinball and varieties of head-to-head games, such as speedball. The game board structure may be configured for either of the two primary play modes, and within those primary modes may be configured to provide variations, including various degrees of difficulty.

Pursuant to the above, the invention provides that the three panel assemblies 21–23 can be quickly and easily assembled together to form the rigid game board structure 20. When desired, the game board structure can be disassembled and put away, to be reassembled at a later time.

With reference to FIG. 2*a*, the panel assembly 22 is a hollow box-like structure similar to the central panel assembly 21. It is comprised of an upper panel 27, a lower panel (not shown), opposite side edge panels 28, an inner end edge panel 29 and an outer end edge panel 30. The opposite end panel assembly 23, shown in FIG. 2*c*, is largely similar in construction to the panel 22, being comprised of an upper panel 31, opposite side edge panels 32, an inner end panel 33 and an outer end panel 34.

In the preferred and illustrated form of the invention, each of the end panels 22, 23 is formed along its inner end edge with a pair of dovetail projections 35, 36. These dovetail projections are adapted to be received in similarly configured recesses 39, 40 and 41, 42 formed along the opposite end edges 26 of the central panel assembly 21. When the projections 36–38 of the end panel assemblies 22, 23 are fully received in the recesses 39–42 of the central panel assembly 21, the upper panels 24, 27 and 31 of the three panel assemblies form a generally flat playing surface, as is evident in FIG. 1.

In the preferred forms of the invention, and as illustrated in FIGS. 1–4, the dovetail projections 35, 36 of the panel assembly 22 and 37, 38 of the panel assembly 23 are of different depths. In particular, the projections 35 and 38 extend for slightly less than the full depth of the panel assembly (see FIG. 3), and the recesses 40, 42 adapted to receive them are of the same depth, with a bottom wall 43 being provided in the recess to limit the downward movement of the projection 35. The adjacent projections 36, 37 are of considerably less depth, being approximately half the depth of the panel assembly from which they extend. Likewise, the recesses 44 of the center panel assembly 22 in which they are received are of a corresponding depth such that, when the projections 36, 37 are received in the recesses 34 the upper panels 27, 31 of the respective end panel assemblies 22, 23 are properly aligned with the upper panel 24 of the center panel assembly 22. Additionally, each of the partial depth projections and recesses mounts a mating multi-pin connector set 45, 46 such that, when the individual panel assemblies are mechanically joined, they are also electrically connected. The multi-pin connector sets enable all three of the panel assemblies 21–23, when mechanically joined, to provide electrical connections throughout the interior of the game board structure for score keeping, motor and control functions, etc.

To advantage, confronting end surfaces of the panels may be provided with auxiliary friction means, to facilitate retention of the several panel assemblies in their desired assembled relationships, during the initial assembly process. These can be provided by plastic spring elements 47 on the inner end panels 29, 33 of the respective end panel assemblies 22, 23. To particular advantage, moreover, rigid stiffening plates 48 are provided at each side of the game board structure, bridging the joints between the panels 21—23. The stiffening plates 48 are molded of rigid plastic material and are comprised of side panels 49 and flanges 50 extending inwardly along upper edges of the side panels. The stiffening plates are provided adjacent each end thereof with a pair of through openings 51 arranged to receive vertically spaced pins 52 provided on the side panels of each of the panel assemblies 21–23. When the panel assemblies are joined in the manner shown in FIG. 1, a set of pins 52 on an adjacent connected pair of panels are positioned to be received in the openings 51 and stiffening plates 48, when the plates are applied to the joined panels at each side. The application of the stiffening panels prevents vertical displacement of one panel assembly relative to its neighbor and also imparts additional structural stiffness to the assembled game board structure, augmenting the connections provided by the projections 35–38 and recesses 39–42.

In preferred embodiments of the invention, the kit of component parts provided to the user desirably includes one or more reversible graphics panels 53 (see FIGS. 4, 5) of a suitable (typically plastic) material. The graphics panel serves the dual function of providing an appropriate game board illustration for the mode in which the assembly is to be utilized, and also to provide a smooth working surface for a rolling ball, covering joints between the panel assemblies, screw holes, mold marks, etc.

To advantage, the flanges 50 of the stiffening plates 48 are arranged to project inwardly into overlying relation to the upper panels 27, 31 and 24 of the respective panel assemblies 21–23, to engage and retain edge margins 54 of the graphics panel 53 (see FIG. 5). The graphics panel can be easily removed from underneath the flanges 50, reversed, and replaced, or removed and stored when dismantling the game board structure.

Pursuant to one aspect of the invention, the several panel assemblies 21–23 are provided with several types of openings in their respective upper panels, serving various purposes. Thus, each panel assembly includes a variety of relatively small diameter socket openings 60 suitable for receiving the lower ends of vertically oriented K'NEX rods, typical ones of which are shown in the aforementioned U.S. patents of Joel Glickman, and a representative portion of such rod being indicated at 61 in FIG. 8. Rods inserted in selected ones of these openings 60 provide the basis for constructing game elements such as fixed and movable barrier elements, etc. as desired by the player or players in the design of the game to be played. Additionally, each of the panel assemblies is provided with a plurality of large diameter sockets 62 for the removable reception of spring actuated scoring bumpers 63, of which a plurality may be provided in a typical game construction toy kit. The scoring bumpers 63 and sockets 62 therefor have features of novelty in themselves, and are described and claimed in co-pending Application of Matthias Doepner, Ser. No. 10/059,748, filed concurrently. The scoring bumpers 63 are intended for use principally in the pinball mode of the game board structure, to be described, and for such mode are selectively placed in certain of the sockets 62 according to the preferences of the player. Typically, the number of scoring bumpers 63 is less than the number of sockets 62 therefor so that at least some of the sockets; 62 will at all times be unoccupied. Accordingly, empty sockets 62 can be closed by using circular plugs 64 (see FIG. 6) which can be inserted into and removed from the sockets 62. When the plugs 64 are inserted in the sockets, the upper surfaces 65 thereof are substantially flush with the surrounding upper surface of the graphics panel 53, providing a continuous support surface for a moving game ball.

Inasmuch as the circular plugs 64 will be removed to accommodate installation of scoring bumpers, when used, provisions are made for convenient storage of unused plugs. In the illustrated embodiment of the invention, this is advantageously provided by incorporating cylindrical sockets 66 in the stiffening plates 48 (FIG. 6), arranged to receive stem portions 67 of the plugs. Thus, the plugs are always conveniently available when converting the game board from one mode to another.

For certain (typically most) modes of play, the central panel assembly 21 advantageously incorporates a rotating disc 70, driven by a motor 71 contained within the interior of the panel assembly. The disc can be rotated during the course of play to influence the speed and direction of a ball passing over it. Desirably, the disc is provided with one or more areas 72 of slight surface elevation which can randomly engage a ball rolling over the surface of the disc and vigorously redirect it in a random manner. Desirably, the motor 71 is reversible, and can be connected to respond to game activity, such as engagement of a rolling ball with one of the scoring bumpers 63, to effect reversal of the direction of rotation.

In the illustrated embodiment of the invention, the central panel assembly 21 advantageously is provided on its opposite sides, in straddling relation to the rotating disc 70, with areas 73 which gradually elevate from their inside edges 74 to central portions 75 thereof adjacent to the outer side edges of the panel assembly. Rolling balls encountering these elevated areas will be randomly redirected. Additionally, balls whose motion is redirected by the rotating disc 70 frequently will be directed toward the elevated areas 73, to be again redirected by the contours of those areas. Desirably, the elevated areas 73 are provided along inner edge portions 76 thereof with a narrow recess for receiving an edge margin of the graphics panel 53. It will be understood, of course, that the graphics panel is formed with an opening in the area directly above the rotating disc 70, as well as openings directly above the large socket 62 and the smaller rod-receiving sockets 60. To this end, the top surface of the disc 70 may be elevated slightly to be flush, or nearly so, with the top surface of the graphics panel, to provide a more uniform rolling surface for a game ball.

Pursuant to one aspect of the invention, the game board structure includes means for scoring and means for keeping score, for either the head-to-head mode of play, or the pinball mode of play. For the head-to-head mode of play, it is advantageous to mount a score-keeping panel 80 along one side edge of the game board structure. For this purpose, the central panel assembly 21 is provided along one edge with spaced apart sockets 81, 82 for receiving legs 83, 84 respectively of the score-keeping panel. One of the legs and one of the sockets, in this case leg 83 and socket 84, are provided with a multi-pin electrical connector pair 85, 86 such that, when the legs of the scoring panel are inserted into the sockets 81, 82, the scoring panel is electrically connected to the scoring and control system of the game board structure.

Figure 1:
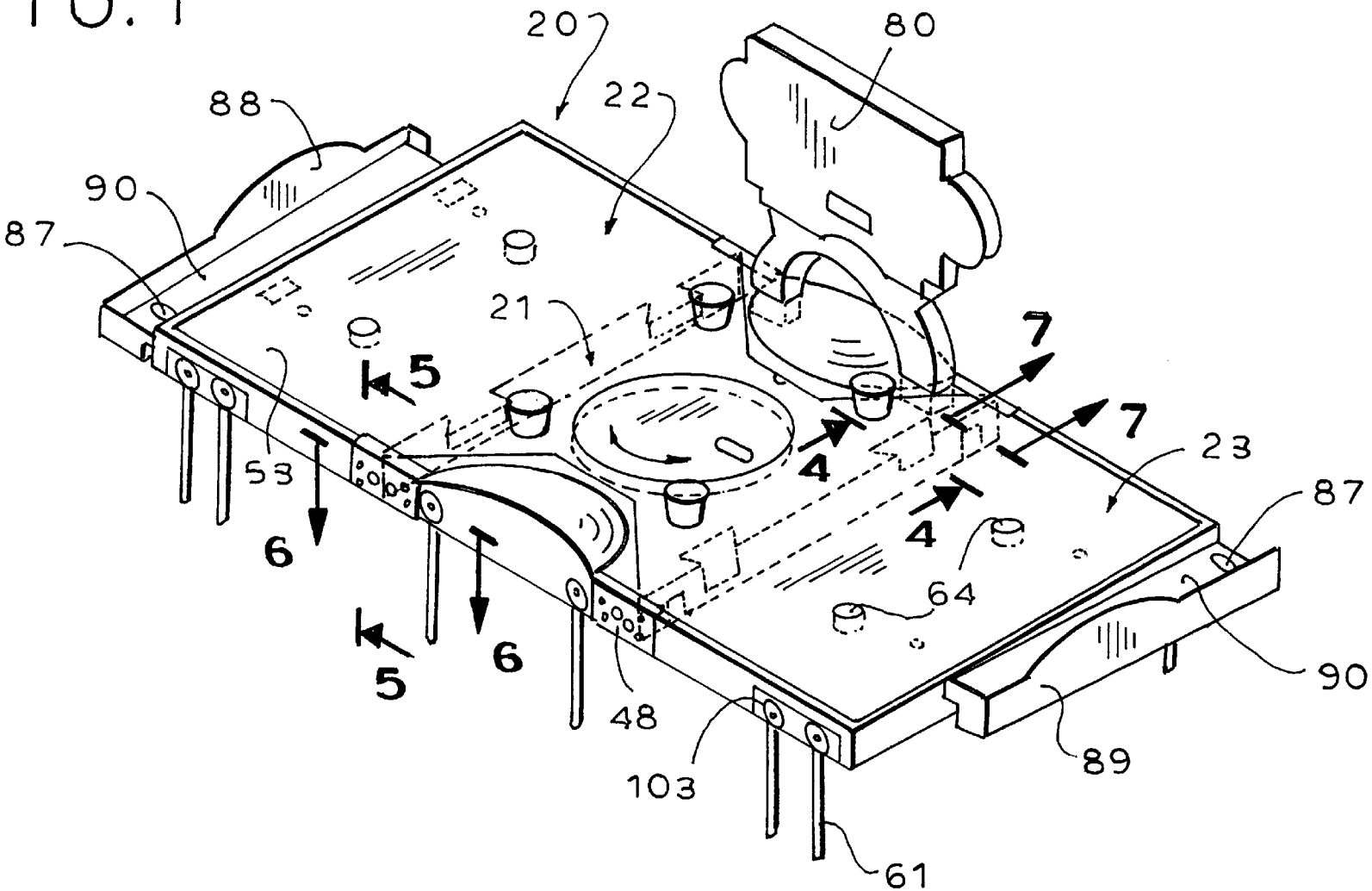
FIG. 1 is a top perspective view of an assembled game board according to the invention, constructed in a mode for head-to-head play by two players.

Scoring indicia within the scoring panel is activated by certain stimuli from the play of the game, such as contact with the scoring bumper 63, the passing of a ball over sensing switches 87 or the like. For head-to-head play of speedball, for example, the game board structure generally as shown in FIG. 1, will be set up, through the addition of various K'NEX rods and connector elements (not shown) to provide a ball confining fence around the perimeter of the panels except in a limited central area at the end extremities forming "goals" in front of ball receiving trays 88, 89, at the outer ends of the game board panel assemblies 22, 23. Through other rod and connector structures (not shown) players at each end of the game board are provided with manually actuable flippers for propelling a ball toward the opposite end of the game board. In the play of a game of speedball or other head-to-head game, a ball projecting by one player through the open "goal" area at the other player's end of the board will result in the ball rolling down an inclined bottom surface 90 of the receiving tray 89 and over the sensing switch 87 to record a score. The ball is then returned to play and the game continues until one player reaches a pre-defined score. Typically, in head-to-head play, if there are bumpers 63 present on the board, contact therewith will not contribute to incrementing the scoring on the panel 80.

Conveniently, for use of the game board structure in a head-to-head mode, the assembled panels are elevated from a support surface, such as a table. To this end, a support structure comprised of K'NEX rods and connectors is assembled. Such a structure is illustrated in a highly schematic sense in the drawings, it being understood that an actual support structure may be comprised of a more complex structure of rods and connectors to provide a relatively rigid and rugged elevated support for the assembled panels, supporting the panels forming the game board structure in a substantially horizontal orientation.

Pursuant to the invention, the side and, if desired, outer end panels of the game board panel structure are provided with sets of mounting pins 100, typically consisting of four outwardly projecting pins 101 (see FIGS. 8 and 9) arranged in a pattern of two vertical and two horizontal pins. The spacing and location of the pins 101 is such as to enable them to be received snugly in openings 102 formed in standard eight-socket connectors 103 of a K'NEX construction toy set.

The connector 103 is shown in detail in FIGS. 8 and 9, and schematically in other views. Reference can be had to the beforementioned Glickman U.S. patents with respect to further details relating to the illustrated connector 103 and similar connectors having fewer sockets, all of which can be employed in assembling structural elements for use in connection with the play of games on the assembled game board structure. In the illustration of FIG. 8, the connector 103 is formed with eight radially opening sockets 104 arrayed at angles of 45 degrees. The arrangement of pins 101 is such that, when the connector is applied thereto, two of the sockets will extend vertically upward and downward, two horizontally, and four at 45 degrees to the vertical. Each socket includes outer gripping portions 105, formed with cylindrically contoured grooves extending axially with respect to the socket, and locking projections 106 at each side which extend transversely through the sockets.

A typical K'NEX rod 61 (FIG. 8) is provided at its ends with a cylindrical portion 107 and an annular groove 108 defining a cylindrical flange 109 at the end extremity of the rod. The connector sockets 104 are open at both sides and are adapted to receive a rod end by lateral insertion. The socket-forming arms 105 flex sufficiently during lateral insertion of the rods to enable the cylindrical portions 107 to be inserted by snap action into the cylindrically contoured grooves formed on the arms 105. The rods are thus gripped firmly by the opposed arms 105 and are effectively locked against axial withdrawal from the socket by reception of the locking projections 106 in the annular groove 108.

In the highly simplified illustrated structure of FIG. 1, there are shown a series of connectors 103 mounted along the side wall panels of the connected panel assemblies 21–23, each with a single rod 61 extending vertically downward therefrom to provide a horizontal elevated support for the game board structure. It will be understood that, in actual practice, these supports would be comprised of subassemblies of multiple rods and connectors of a considerably more substantial nature than in the simplified illustration. The underlying principle however, will be readily apparent to those skilled in the art.

Upwardly extending sockets of the connectors 103 may be used to support upwardly extending rods 110 providing bases for peripheral fencing, for example, according to construction diagrams provided with the set or according to variations provided by the user. Among other things, rod and connector structures (not shown) provided adjacent some or all of the corner areas of the game board structure may include player-actuated mechanisms for mounting and operating flipper elements to propel a playing ball along the surface of the board.

Figure 10:
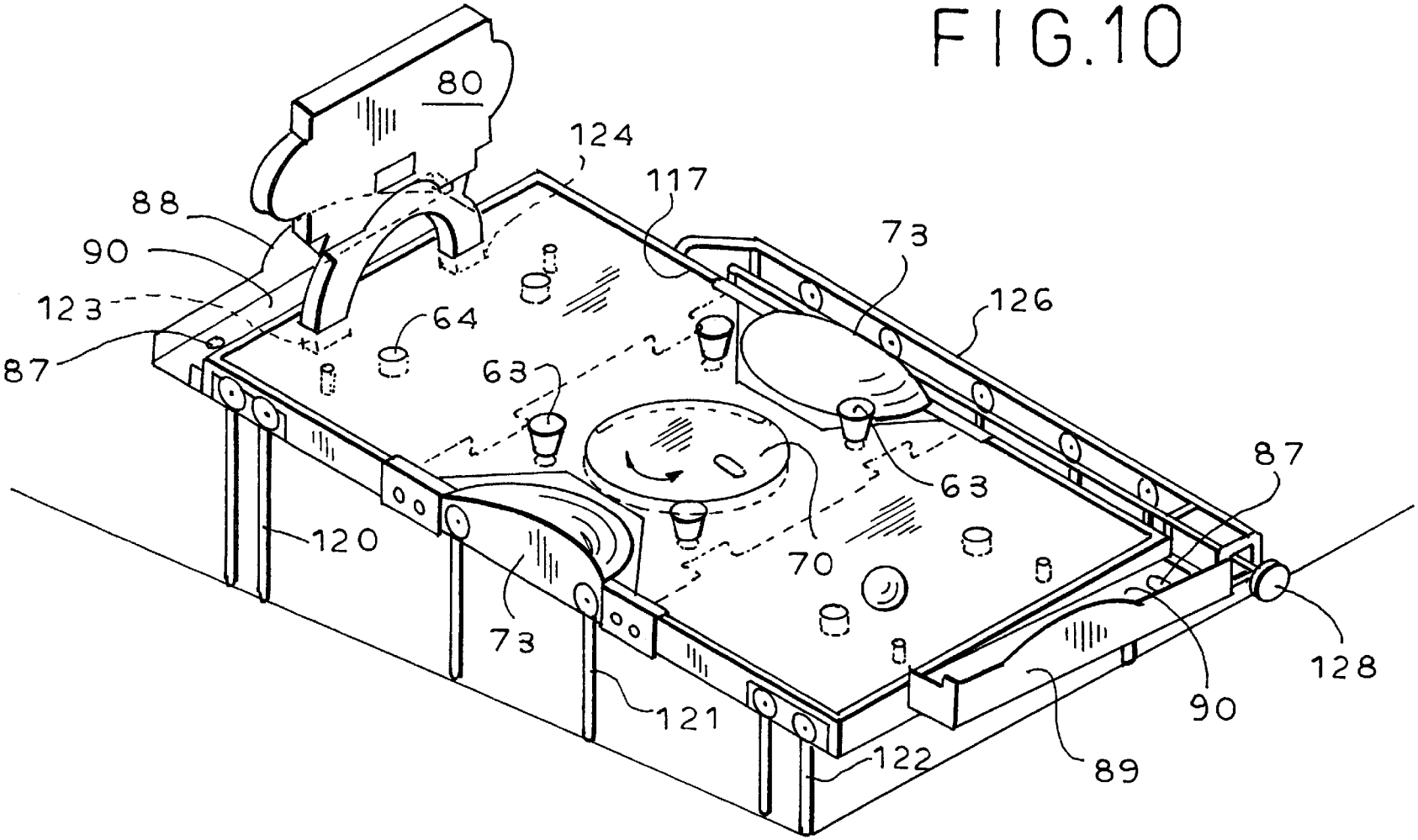
FIG. 10 is a top perspective view, similar to FIG. 1, illustrating the game board structure arranged in an alternative manner, for playing pinball, for example.

Configuring the game board structure for pinball play involves several aspects of reconstruction. These are indicated in FIG. 10 of the drawings. Among other things, the underlying support structure is comprised of rods 120, 121, 122 of progressively shorter length so that the playing board tilts upwardly from the front (the right side in FIG. 10) to the back of the game board structure. As described in connection with the head-to-head play mode, the supporting structure represented in FIG. 10 would in a typical structure, involve a multi rod/multi connector structure of some rigidity and durability to provide strong and solid support for the game board structure. The score-keeping panel 80 is extracted from the sockets 81, 82 of the central panel assembly 21, if previously installed therein, and is inserted into similar sockets 123, 124 provided in the upper end panel assembly 22. The multi-pin electrical connector 85, provided in the support leg 83 of the scoring panel connects with a counterpart connector 125 in the recess 123 (FIG. 2*a*) so that the scoring panel is electrically connected to the game playing system.

In addition to suitable peripheral fencing provided around the sides of the game board by rod and connector assemblies (not shown) formed by the player from the construction toy kit components, the pinball mode also includes a ball projection path 126, formed of rods and connectors, which guides a projected play ball toward the elevated end of the game board structure and discharges it on to the play surface through an outlet opening provided at 127. A suitable rubberband-actuated plunger mechanism 128 is provided at the lower end of the ball projection path, for initiating movement of a play ball upwardly along the path and on to the playing surface.

Once a ball 129 enters the playing surface, it tends to seek its way to the lower end of the game board structure, randomly encountering the scoring bumpers 63, the elevated side portions 73 and the rotating disc 70. When the ball rolls on to the surface of the disc 70, it typically is flung rigorously off of the disc in a random manner in any direction. Each time a scoring bumper 63 is contacted, the score is incremented on the panel 80, with an object of the game being to keep the ball in play as long as possible to achieve the highest score.

Adjacent to the lower end of the inclined game board structure, the player will have previously constructed flipper elements (not shown) typically one on each side, so that the play ball, if rolling into the reach of the flipper elements, can be projected back up the surface of the playing board, by adroit action of the player.

Eventually, in the pinball mode, a ball will roll downward into the collecting tray 89 at the lower end of the board, at which time it will roll down the inclined surface 90 and trip the sensing switch 87 triggering a scoring action. For example, three actuations of the sensing switch 87 may signal the end of a particular player's turn at the game.

The complexity of the game may be easily varied by changing the position of some or all of the scoring bumper 63. Whereas in the illustration of FIG. 10 all four scoring bumpers are located in the central panel assembly 21, adjacent to the rotating disc 70, some or all of them may be moved to the sockets provided therefor in the endmost panel assemblies 22, 23. Additionally, various impeding structures may be formed on the play area using K'NEX rods inserted into the various smaller diameter openings 60 provided in the several game board panel assemblies 21–23.

Customarily, although not necessarily, the graphics panel 53 will be reversed when changing from a head-to-head mode to a pinball mode, so that the visible graphics are more appropriate to the selected mode.

The game board structure of the invention is uniquely advantageous in that it enables a fully operational game board, with multiple play modes, to be provided in the form of a construction toy kit. The major components of such a kit comprise the three principal game board panel assemblies 21–23 and the scoring panel 80. When disassembled, these components can be easily packaged in a convenient suitcase-size package for marketing and subsequent storage. A typical kit according to the invention will include a variety of standard K'NEX rod and connector components and detailed instructions for the assembly of games in both the pinball mode and the head-to-head speedball mode. The player is thus provided with a wide variety of game configurations, which may be made from the directions provided, or which may be derived from the player's own ingenuity. Among other things, the invention contemplates that structural elements may be provided in the kit to install a motorized ball elevator at the upper end of the pinball unit, for installation adjacent the discharge end of the ball receiving tray 88 at the upper end of the game board. A limited access opening (not shown) can be constructed from the K'NEX components, to provide limited access for a play ball to enter the tray 88 at the upper end of the board. A ball thus entering the tray will travel along its inclined surface, tripping the sensing switch 87 and registering a bonus score for the player. The sensing switch in such a case will also initiate operation of a motor driven elevator mechanism (not shown) arranged to return the ball to play at the upper end of the board. The variations available to the creative player to add auxiliary structure to the basic game board assembly are virtually limitless.

The three panel assemblies forming the basic, game board structure are easily assembled into a rigid flat structure, which is not only mechanically joined but also electrically connected so that control and scoring functions can be carried out throughout the game board. Simple stiffening plates applied to the side edges of the game board structure, bridging the joints between panel assemblies, serve to lock the primary components in their assembled relation and to impart additional rigidity to the overall game board structure.

Once the basic game board structure is assembled, it can be modified in a wide variety of ways for head-to-head game playing, pinball games, etc. in great measure using standard K'NEX rod and connector components provided in the packaged kit.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

We claim:

1. A game board structure for a construction toy set, which comprises (a) first and second game board panel assemblies of generally rectangular configuration, each with spaced apart side edge panels, end edge panels and upper surfaces panels, (b) one of said game board panel assemblies having spaced apart sockets on one end edge thereof, (c) the other of said game board panel assemblies having projections extending from one end edge panel thereof and engageable with said sockets to enable said game board panel assemblies to be engaged with the upper surface panels thereof generally in a common plane, (d) at least one mutually engageable set of said projections and sockets being formed with electrical connections for the transfer of electrical signals between engaged game board panel assemblies, (e) said game board panel assemblies, when engaged, defining a joint between said last mentioned end edge panels, and (f) stiffening plates removably attachable to opposite side edge panels of said game board panel assemblies, bridging said joint.

2. A game board structure according to claim 1, wherein (a) said stiffening plates and said side edge panels have mutually engageable pins and recesses on opposite sides of said joint for removably securing said stiffening plates to said game board panel assemblies and locking said panel assemblies in joined and aligned relation.

3. A game board structure according to claim 1, wherein (a) said projections being configured to form a neck portion and an enlarged head portion and said sockets being in the form of upwardly opening recesses corresponding in shape and size to said projections, (b) said panel assemblies having a predetermined thickness, (c) one of said projections being of substantially less thickness than said predetermined thickness, and the corresponding recess which is adapted to receive said last mentioned projection being of a depth corresponding to the thickness of said projection, and (d) said last mentioned projection and recess mounting interengageable electrical plug and socket elements for establishing electrical connections between said panel assemblies when said projections are received in said sockets.

4. A game board structure according to claim 1, wherein (a) said stiffening plates include flanges at upper edge portions thereof positioned to project inwardly over portions of the upper surface panels of said game board panel assemblies.

5. A game board structure according to claim 4, wherein (a) a removable graphics panel is provided, which is adapted to be placed over the joined game board assemblies to form a playing surface, and (b) side margin areas of said graphics panel are positioned underneath said flanges.

6. A game board structure according to claim 1, wherein (a) one of said game board panel assemblies includes a rotatable disc forming part if its upper surface panel, and (b) drive means are provided for rotating said disc during use of said game board structure, (c) said disc having a surface interruption engageable with a moving ball disposed upon said disc, for changing the direction of movement of said ball.

7. A game board structure according to claim 1, wherein (a) the upper surface panels of said engaged panel assemblies are formed with a plurality of first openings therein for the selective reception of game elements and a plurality of second openings therein for the selective reception of rod elements of a construction toy set.

8. A game board structure according to claim 1, wherein (a) the side edge panels of said game board panel assemblies are formed with pins projecting therefrom for engagement with openings in connector elements of a construction toy set.

9. A game board structure according to claim 1, which further includes (a) a game scoring structure having a score indicator, and (b) at least one of said game panel assemblies is formed with socket means for engaging and supporting said scoring structure and providing electrical connections thereto.

10. A game board structure for a construction toy set, which comprises (a) first, second and third game board panel assemblies of generally rectangular configuration, each with spaced apart side edge panels, end edge panels and upper surface panels, (b) said panel assemblies being arranged to be positioned in a line, with opposite end edge panels of a centrally disposed first panel assembly in juxtaposed and abutting relation to end edge panels of said second and third panels, (c) interengaging pairs of sockets and projections positioned along the juxtaposed and abutting edges of said panels enabling said panel assemblies to be engaged with their respective upper surface panels generally in a common plane, (d) at least one pair of said sockets and projections associated with each end of said first panel assembly including electrical connections for the transfer of electrical signals between engaged panel assemblies, (e) the upper surface panel of at least said first panel assembly having a plurality of openings therein for the selective reception of game elements, and (f) a graphics panel adapted to be removably supported on the upper surface panels of said panel assembly.

11. A game board structure according to claim 10, wherein (a) said graphics panel is provided with printed graphics on opposite surfaces thereof related to two different games associated with said game board structure, and (b) said graphics panel is alternatively positioned on said structure with one or the other of its printed graphics surfaces facing upwardly.

12. A game board structure according to claim 11, wherein (a) said game board panel assemblies, when engaged, defining joints between juxtaposed end edge panels, (b) stiffening plates are removably attachable to opposite side edge panels in the region of and spanning said joints, (c) said stiffening plates and said side edge panels in said last mentioned regions having mutually engageable projections and recesses on opposite sides of said joints for removably securing said stiffening plates to said game board panel assemblies and locking said panel assemblies in joined and aligned relation.

13. A game board structure according to claim 12, wherein (a) said stiffening plates include flanges at upper edge portions thereof positioned to project inwardly over portions of the upper surface panels of said game board panel assemblies.

14. A game board structure according to claim 13, wherein (a) side margin areas of said graphics panel are positioned underneath said flanges.

15. A game board structure according to claim 11, wherein (a) said structure is provided as a disassembled kit, including a variety of rods and connectors of a rod-and-connector construction toy, (b) said rods and connectors being adapted for assembly in a variety of combinations related to different game procedures indicated by said graphics panel.

16. A game board structure according to claim 10, wherein (a) scoring sensors are selectively and removably installed in said openings, and (b) cover elements are provided for selective and removable insertion in those of said openings in which scoring sensors are not installed.

17. A game board structure according to claim 16, wherein (a) said game board panel assemblies, when engaged, defining joints between juxtaposed end edge panels, (b) stiffening plates are removably attachable to opposite side edge panels in the region of and spanning said joints, (c) said stiffening plates and said side edge panels in said last mentioned regions having mutually engageable projections and recesses on opposite sides of said joints for removably securing said stiffening plates to said game board panel assemblies and locking said panel assemblies in joined and aligned relation, and (d) said stiffening plates are provided with a plurality of openings therein for the reception and storage of said cover elements when not installed in said openings.

18. A game board structure according to claim 10, which further includes (a) a game scoring structure having a score indicator, and (b) said third game board panel assembly is formed with an upwardly opening socket in its upper surface panel for the reception and support of said game scoring structure, (c) said last mentioned socket having an electrical plug element therein for engagement with a mating electrical plug element on said game scoring structure.

19. A game board structure according to claim 18 wherein (a) said first panel assembly is formed with an upwardly opening game scoring socket in its upper surface panel for the reception and support of said game scoring structure, (b) said last mentioned game scoring socket having an electrical plug element therein for engagement with a mating electrical plug element on said game scoring structure, (c) said game scoring structure being selectively and removably inserted in the respective game scoring sockets therefor in said first panel assembly or said third panel assembly.

20. A game board structure according to claim 10, wherein (a) the upper surface panel of at certain of said panel assemblies, including said first panel assembly, having openings therein for the selective and removable insertion of rod elements of a rod-and-connector construction toy set.

21. A game board structure according to claim 20, wherein (a) the side edge panels of at least certain of said game board panel assemblies being formed with groups of outwardly extending pins for the reception and retention of connector elements, and (b) said connector elements are engageable with rods to form a support structure for said game board panel assemblies.

22. A game board structure according to claim 20, wherein (a) the game scoring socket of said third panel assembly is located adjacent an end edge thereof, and (b) the game scoring socket of said first panel assembly is located adjacent a side edge thereof.

23. A game board structure according to claim 10, wherein (a) said first game board panel assembly includes a rotatable disc forming part if its upper surface panel, and (b) drive means are provided within said panel assembly for rotating said disc during use of said game board structure, (c) said disc having a surface interruption engageable with a moving ball disposed upon said disc, for changing the direction of movement of said ball.

24. A game board structure according to claim 23, wherein (a) elevated mounds are provided on said first panel assembly, on opposite sides thereof and straddling said rotatable disc, (b) said mounds serving to randomly redirect by gravity a game ball rolling onto a surface of said mounds.

25. A game board structure according to claim 10, wherein (a) said projections are configured to form a narrower neck portion and a wider end portion, and said sockets are in the form of upwardly opening recesses corresponding in shape and size to said projections, (b) said panel assemblies having a predetermined thickness, (c) one of said projections being of substantially less thickness than said predetermined thickness, and the corresponding recess which is adapted to receive said last mentioned projection being of a depth corresponding to the thickness of said projection, and (d) said last mentioned projection and recess mounting interengagable electrical plug and socket elements for establishing electrical connections between said panel assemblies when said projections are received in said sockets.

26. A game board structure according to claim 10, wherein (a) said structure is provided as a disassembled kit, including a variety of rods and connectors of a rod-and-connector construction toy.

* * * * *